US007472906B2

(12) United States Patent
Shai

(10) Patent No.: US 7,472,906 B2
(45) Date of Patent: Jan. 6, 2009

(54) AUTOMATIC CARD SHUFFLER AND DEALER

(76) Inventor: Moti Shai, 3524 via del prado, Calabasas, CA (US) 91302

( * ) Notice: Subject to any disclaimer, the term of this patent is extended or adjusted under 35 U.S.C. 154(b) by 37 days.

(21) Appl. No.: 11/036,858

(22) Filed: Jan. 18, 2005

(65) Prior Publication Data

US 2006/0157930 A1 Jul. 20, 2006

(51) Int. Cl.
*A63F 1/12* (2006.01)
*A63F 1/14* (2006.01)

(52) U.S. Cl. ..... 273/149 R

(58) Field of Classification Search ..... 273/149 R, 273/149 P, 148 R; 463/22
See application file for complete search history.

(56) References Cited

U.S. PATENT DOCUMENTS 1,028,286 A * 6/1912 Schmidt ..... 273/149 R
2,036,148 A * 3/1936 Koenigsberger ..... 273/149 R
2,044,266 A * 6/1936 Weber ..... 273/149 R
2,731,271 A * 1/1956 Brown ..... 273/149 R
2,778,644 A * 1/1957 Stephenson ..... 273/149 R
3,232,622 A * 2/1966 Lambert ..... 273/149 R
3,627,331 A * 12/1971 Erickson ..... 273/149 R
3,666,270 A * 5/1972 Mazur ..... 273/149 R
4,309,035 A * 1/1982 Goldfarb ..... 273/237
4,667,959 A * 5/1987 Pfeiffer et al. ..... 273/149 R

* cited by examiner

*Primary Examiner*—Gene Kim
*Assistant Examiner*—Alyssa M Hylinski
(74) *Attorney, Agent, or Firm*—Moti Shai

(57) ABSTRACT

An automatic system for shuffling and distributing cards includes two embodiments. One embodiment includes fixed and rotating plates on which a deck of cards is supported. The device according to this embodiment, can be placed on the table. Shuffling is achieved by a plurality of card magazines and delivery trays located on the rotating plate. The fixed plate includes fixed card ejection devices which operate during and in response to rotation of the rotating plate, which eject cards at a plurality of locations about the system. The device is electrically powered and includes means to automatically stop its rotation after the last card in the deck has been distributed. In another embodiment, a hand-hold device is designed so the user can hold it in one hand and by pressing on switch the topmost card is automatically ejected to the location aimed by the user.

17 Claims, 4 Drawing Sheets

AUTOMATIC CARD SHUFFLER AND DEALER

BACKGROUND OF THE INVENTION

1. Field of the Invention

The present invention relates to an automatic device for shuffling and distributing playing cards.

2. Description of the Related Art

While playing card distributing devices have been proposed previously, they generally present a number of difficulties and problems. Typically, the prior card distributing devices are manually operated in that they must be started, operated and stopped by hand. In general, they employ a mode of operation in which a card is selected and pushed away partly from the deck, the card then being engaged and ejected by a separate spring-type of device. Such devices generally are mechanically complicated, are noisy and work relatively slow. In addition, they often do not operate properly when the cards have been used or slightly worn and, frequently, the devices tend to deteriorate rapidly and the condition of the cards, thus exaggerating the inherent difficulties. Most of the existing card distributing devices do not shuffle and the small percentages of those that do, do so by re-dealing the cards multiple times, which is time consuming.

In the inventions by Francoise Pic U.S. Pat. No. 4,033,590, and J. R. Stephenson U.S. Pat. No. 2,778,644, R. Gronnerberg U.S. Pat. No. 3,131,935, and Frank A. Mazar U.S. Pat. No. 3,666,270, the distribution of cards is not reliable because sometimes the ejector device doesn't eject the engaged card and sometimes it pulls out two cards at a time. This is the main reason for not finding these devices on the market. None of the above-mentioned patens work in the same efficient and improved manner as current invention. In the current invention, in one embodiment, the card magazine, which is tilted to a predefined angle, is pivotally rotating, which allows the ejector device to reliably pull a single card every time the ejector engages the cards. The magazine is pushed back to its original position by a spring located behind the card magazine—this makes the current invention much more reliable that any other related invention on the market. In another embodiment, of the present invention, a user holds in one hand and by pressing on on switch the device automatically ejects the topmost card to the location that the user aimed to, which makes this device portable and it doesn't take room from the playing area.

It is among the primary objects of the invention to provide an improved automatic playing card shuffling and ejection device which avoids the foregoing and other difficulties.

Another object of the invention is to provide a clear playing area without removing the system. One of the embodiments is located underneath the playing plate and the other embodiment reuses the existing playing area. Other dealing systems must be removed to provide clean playing area for the players which make it very cumbersome and inefficient to use.

Other objects, advantages and features of the present invention will become more apparent upon reading of the following non-restrictive description of preferred embodiments thereof, given by the way of example only with reference to the accompanying drawings.

SUMMARY OF THE INVENTION

In one of the embodiments, the device includes a fixed plate, a rotating plate, which is rotatably mounted to the fixed plate, and a playing plate, which is located on top of the system and provides clear playing area. An electrical motor is mounted in the system and is connected to the rotatable plate to rotate the plate when the device is in operation. The rotatable plate carries two card holders which hold a deck of playing cards at a predefined angle to guarantee ejection of single topmost card from each card magazine and to place it on the serving tray, which is responsible for dealing the cards to all the players in a rotation manner. The fixed plate comprises a plurality, as the number of players, of static card ejectors—when the system is rotating the ejector engages and ejects a single topmost card from the card magazine pushing it to a delivery tray which guides the card to the table in front of individual player for each cycle. The ejection mechanism is operated in response to rotation of the system with respect to the platform, and reciprocates a plurality of times for each complete revolution of the table, thus ejecting a card from the top of the deck a number of times during rotation of the device. The cards are ejected to a plurality of locations circumferentially spaced about the device.

The operation of the device is begun by placing light pressure on the switch arm which causes the platform to rotate with respect to the fixed base, releasing the pressure stops the rotation of the platform which stop dealing the cards. An automatic rotation of the platform is achieved by an electrical motor, powered by a battery. Optionally, the switch arm can be pressed down and locked, which will force all the cards to be delivered. The device will automatically stop when the last card will be delivered. One of the advantages of this embodiment is to provide a shuffling device by placing plurality of card holders and delivery trays.

In another embodiment of the present invention, the device is designed so the user can hold it in one hand by pressing on the on switch, the ejectors engage the topmost card of the deck, which ejects it smoothly, but firmly and without damaging the card. This device is portable and doesn't require any preparation to the playing area prior to dealing the cards and it doesn't take room from the playing area. The concept of the device is exactly like a user dealing the card by hand, but its done automatically, and by one hand.

The ejection device is designed to engage the topmost card of the deck smoothly, but firmly and without damaging the card. The ejection devices are adjustable for better card ejection and they are easily removable to fit number of players.

It is among the objects of the invention to provide an improved automatic playing card distributing device.

A further object of the invention is to provide a card distributing device which may be used with new or used playing cards and which minimizes the chance of the device becoming jammed.

BRIEF DESCRIPTION OF THE DRAWINGS

The foregoing and other objects and advantages of the invention will be understood more fully from the following further description, with reference to the accompanying drawings wherein.

DETAILED DESCRIPTION

The present invention is directed to an improved system and method for providing easy to use automatic playing card shuffling and dealing system. The preferred embodiments of the improved system and method are fully and detailed illustrated and described in the following paragraphs.

Figure 1:
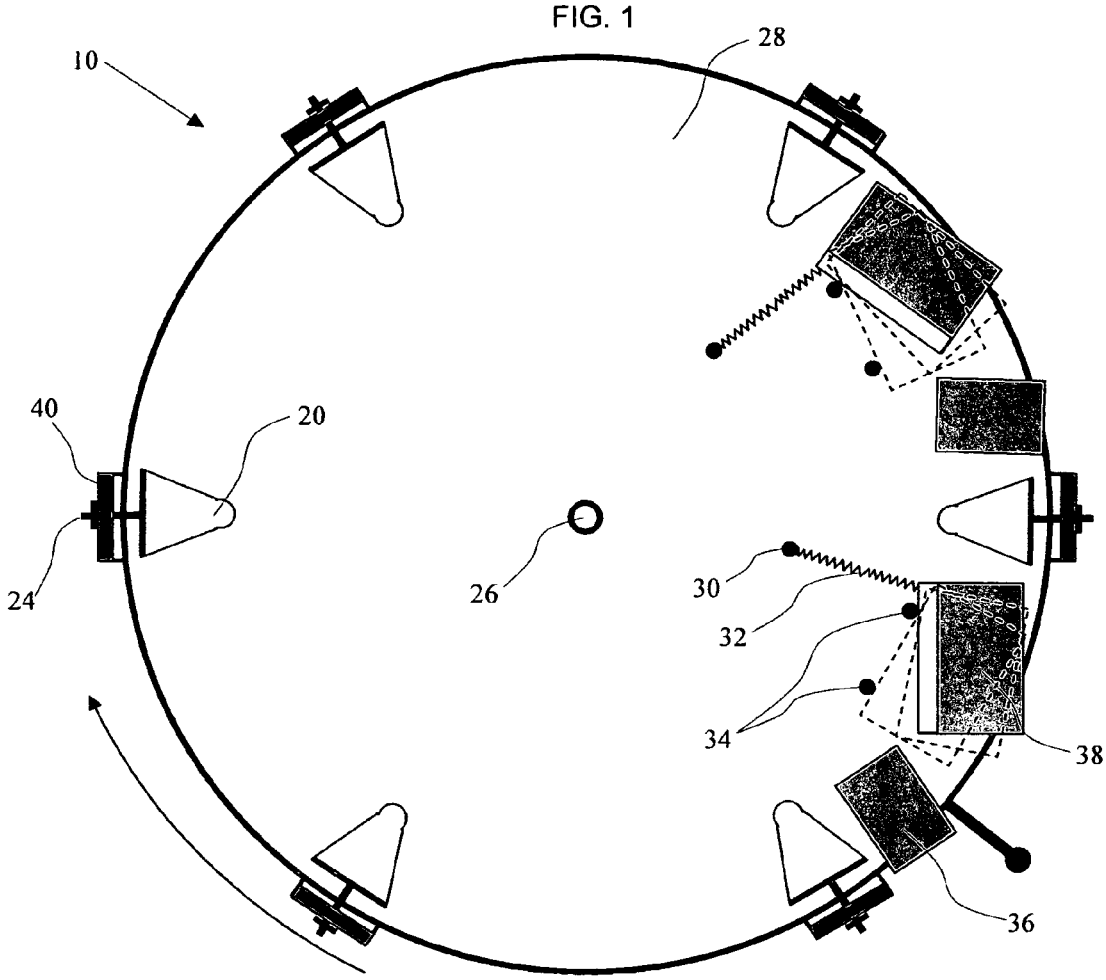
FIG. 1 is a top view of the rotating card shuffler and dealer—main embodiment.
Figure 2:
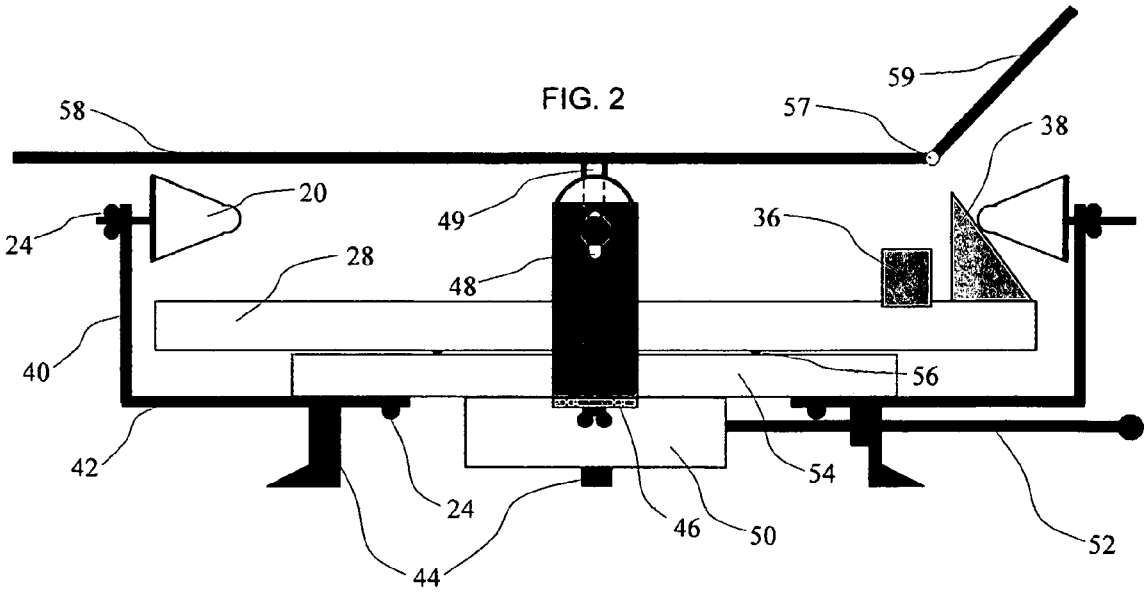
FIG. 2 is a side view of the rotating card shuffler and dealer.
Figure 3:
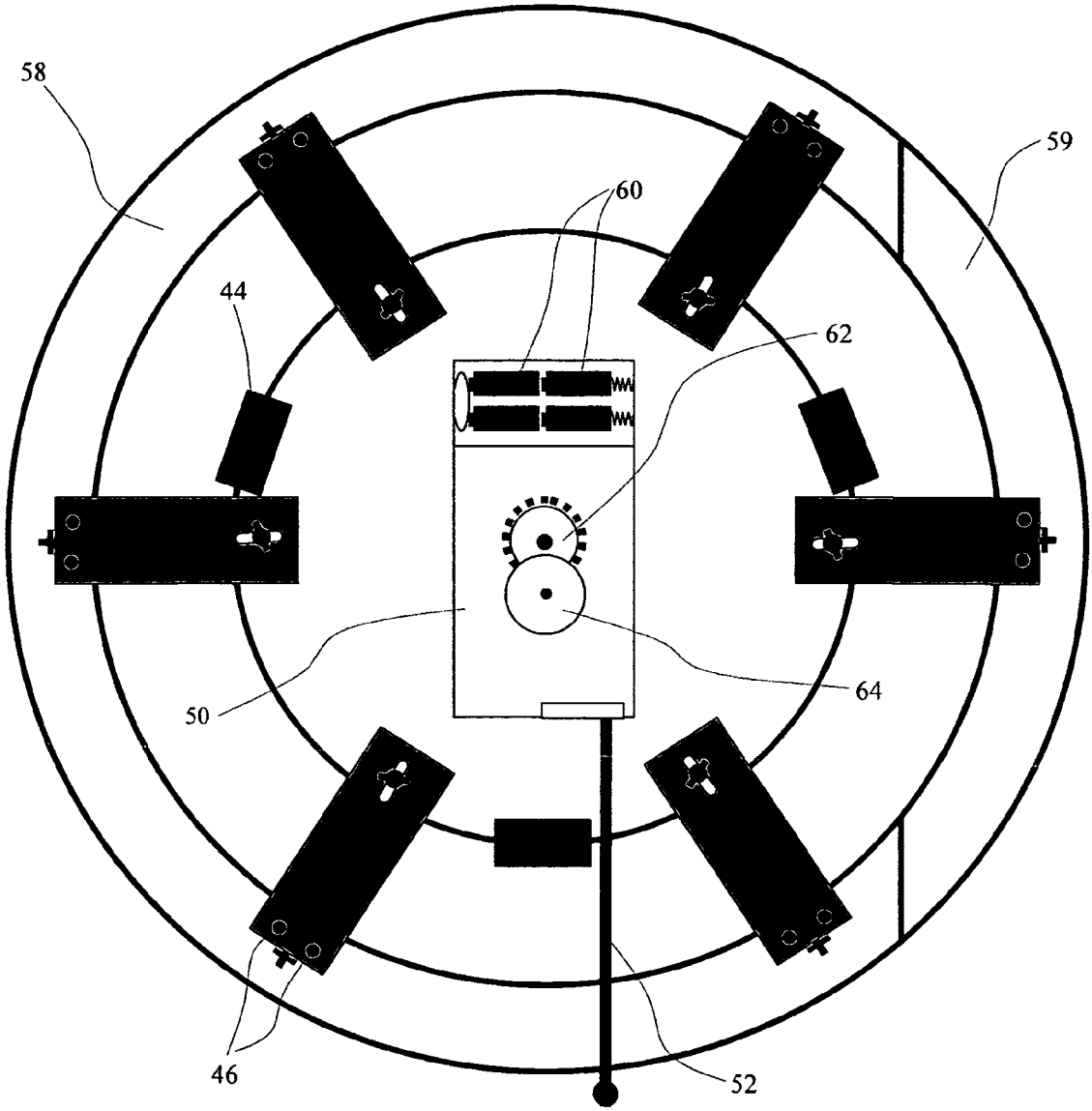
FIG. 3 is a bottom view of the rotating card shuffler and dealer.

As illustrated in FIGS. 1, 2 and 3, in a main embodiment, a rotating card shuffler and dealer with the present invention system 10 is provided and comprises a rotating plate 28, including a top and a bottom, which rotates about a pivot axis 26, operated by batteries 60, best shown in FIG. 3. Two or three card magazines 38 are conveniently located on the top of the rotating plate 28, each of which has a plurality of rotation stoppers 34 and a spring 32 which is connected to a anchor 30. The rotating plate 28 also includes the same number of delivery trays 36 each of which is located close to the card magazines 38. The fixed plate 54 is located beneath rotating plate 28 with conventional rotating means 56 sandwiched between these plates. An adjustable arm 42, best shown in FIG. 2, is connected by conventional fasten means 24, to the bottom of the fixed plate 54. A removably ejector arm 40 has built-in conventional pins 46 which are inserted into corresponding holes into the adjustable arm 42. A flexible adjustable ejector head 20 is connected to the ejector arm 40 by conventional fastening means 24. An operation box 50, best shown in FIG. 3, is attached to the bottom of the fixed plate 54, and includes conventional batteries 60, a electrical motor 64, a gear 62, and an arm switch 52. The system has three legs 44 which are connected to the bottom of the fixed plate 54. A playing plate 58, which provides a clear playing area, covers the system and is connected to the fixed plate 54 by a pivot 49. An opening window 59 is connected to the playing plate 58 by a conventional hinge 57 and provides an easy access to card magazines 38 for cards reloading.

Referring to FIGS. 1, 2 and 3, in a method for the use of a main embodiment in accordance with the present invention, the system 10 enables reliable shuffling and dealing method of playing cards to up to eight players. Initially playing cards are manually divided approximately between, and placed into the card magazines 38, which are pivotally located on top of the rotating plate 28. The system may include two or three card magazines 38 for better and more efficient shuffling. Dealing of the cards starts by placing a finger on the arm switch 52 which cause the rotating plate 28, powered by batteries, to start its rotational cycles. Every time the card magazine 38 rotates with the plate 28, the card magazine 38 comes in contact with flexible ejector head 20, which is not rotating, the topmost card is then pushed to the tray 36 which in turn guides the card to the player in a slidable manner. The flexible ejector head 20 can be made out of rubber or the like. The card magazine 38 pivotally rotates when engaged with ejector head 20 to guaranty full and smooth ejection of the cards. The spring 32 is responsible to return the card magazine 38 to its original location after the topmost card has been taken away. Rotation of the magazine 38 is finished by the stoppers 34. Card dealing stops when the pressure of arm switch 52 is released which stops the rotation. The arm switch 52 can be locked down to deal all the cards from all the magazines 38, the system will stop by the fact that ejector head 20 will hold empty magazine 38 when the last card will be ejected, and this will turn off the system. Ejection mechanisms are vertically and horizontally adjustable for better card ejection. Number of needed ejectors, which can easily be pulled out or inserted, determined by number of players.

Figure 4:
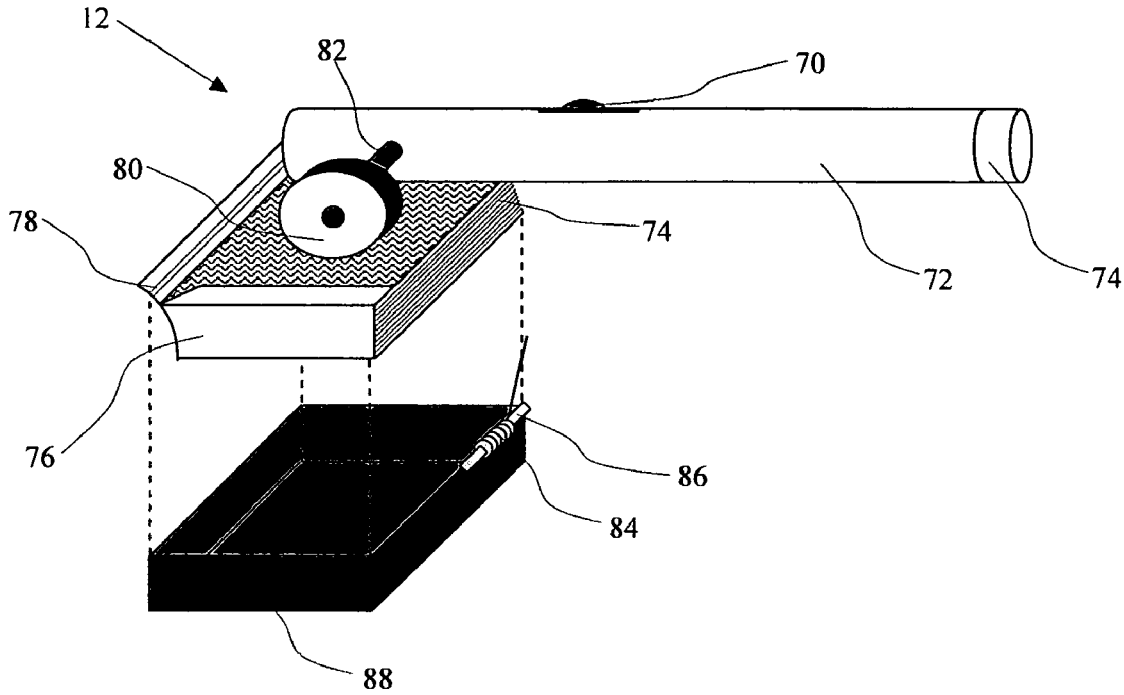
FIG. 4 is a perspective view of another embodiment which is a hand-hold card dealer.
Figure 5:
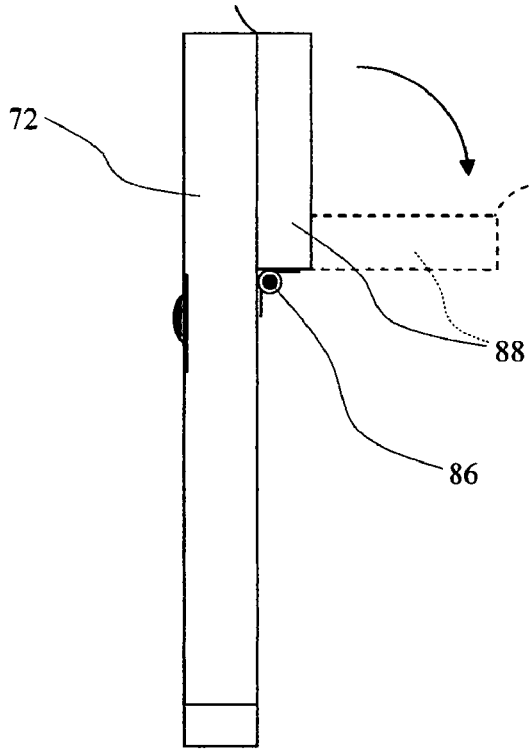
FIG. 5 is a side view of a hand-hold card dealer.

As illustrated in FIGS. 4 and 5, in another embodiment, a hand-hold card dealer with the present invention system 12 comprises hand-hold body 72, which includes an electronic engine and conventional batteries, a batteries lid 74, an on-off switch 70, a rotating card ejector 80, which is connected to a body 72 by an ejector axis 82. Cards 74 are located inside a cards magazine 76 which has a curved front lip with grooves 78. The cards magazine 76 is placed inside a magazine holder 88 has a hinge 86 with a built-in spring 84.

Figure 6:
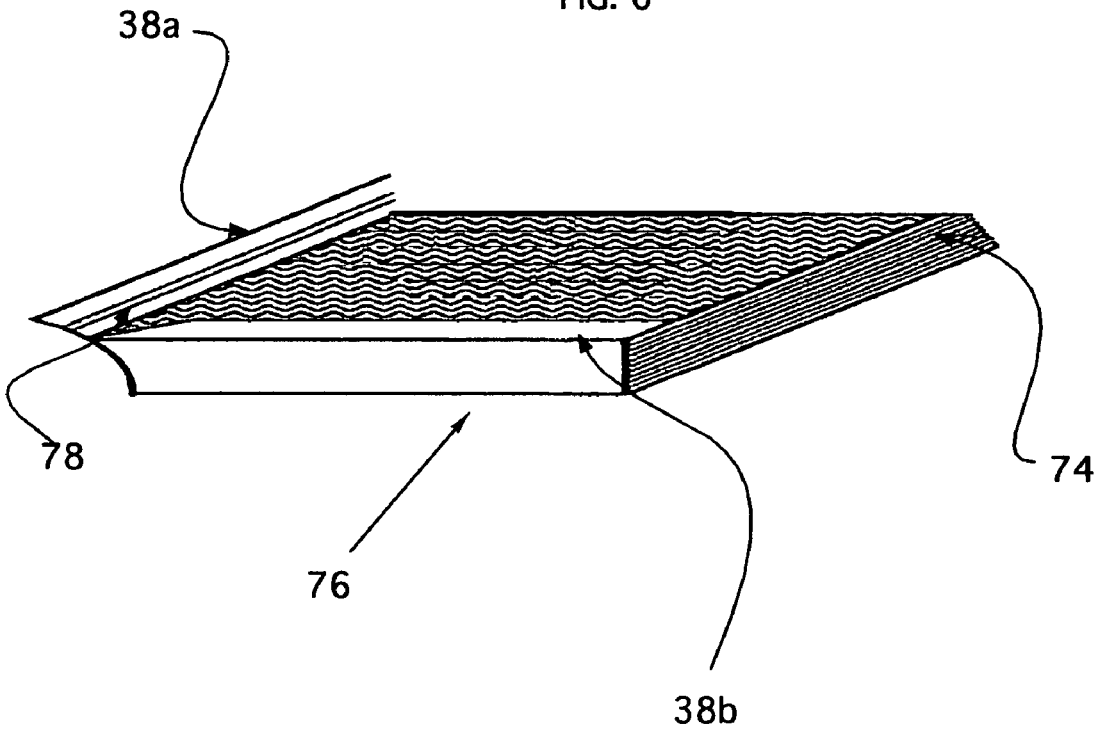
FIG. 6 is a front perspective view of a card magazine.

Referring to FIGS. 4 and 5, in a method for the use of the hand-hold card dealer in accordance with the present invention, the system 12 enables the user automatically to deal cards aiming system 12 to desired locations. The system 12 comprises the hand-hold body 72 which includes a conventional electronic rotational motor powered by conventional batteries and controlled by the on-off switch 70, conveniently located on top of the hand-hold body 72 for easy thumb access. The magazine holder 88 has the ability to be opened downwards (best shown in FIG. 5), then the playing cards may be manually placed inside the cards magazine 76, which is then inserted into the holder 88. The spring 84 then returns the magazine holder 88 to its original position until the top-most card is touching the rotating card ejector 80. FIG. 6 illustrates the card magazine 76, in both embodiments, in detail. The cards are ejected over a lip 38*a* of the cards magazine 76. The curved lip 38*a* is curved in a convex manner to provide smooth ejection until the last card. The curved lip 38*a* has built-in grooves 78 to prevent ejection of multiple cards at the same time. The card magazine 76 also includes side lips 38*b*, which hold the shape of the card deck and facilitate the ejection. The purpose of the spring 84 is to apply pressure on the magazine holder 88 so the top-most card will maintain constant contact with rotating card ejector 80. The electrical motor can be activated by the on-off switch 70, which can be used as a push button, which means the motor is operating as long as the pressure exist, or can be slide to on position. Rotational movement is transferred from the motor through ejector axis 82 to rotating card ejector 80 which ejects single top-most card every rotational cycle. Cards are ejected to the location that the user aims the system to.

In view of the above, it is apparent that the system and method of the preferred embodiments of the present invention enhance substantially reliability, practicality and effectiveness of enabling shuffling and dealing method of playing cards or the like.

While the present invention has been described in connection with the specific embodiments identified herein, it will be apparent to those skilled in the art that many alternatives, modifications and variations are possible in light of the above description. Accordingly, the invention is intended to embrace all such alternatives, modifications and variations as may fall within the spirit and scope of the invention disclosed herein.

What is claimed is:

1. An improved device for providing a user an automatic card shuffler and dealer, powered by electrical motor, enabling play of recreational card games for a plurality of players sitting around said device while said device automatically ejects playing cards to a plurality of locations circumferentially spaced about said device, said device comprising:

a rotatable plate, including a top and a bottom;

a fixed plate, contacting said bottom of said rotatable plate, operated by an electrical motor, controlled by an arm switch;

a plurality of card magazines, to hold playing cards, including a built-in spring and a plurality of stoppers, wherein said plurality of card magazines pivotally rotate in a first direction, said built-in spring retracting said plurality of card magazines in a second direction, said plurality of stoppers limiting said first and second directions;

a plurality of delivery trays to guide ejected cards away from said device;

a plurality of flexible card ejectors; and a playing plate.

2. The device of claim 1 wherein said plurality of card magazines, hold playing cards organized to form a trapezoid shape.

3. The device of claim 1 wherein said plurality of card magazines have a curved lip.

4. The device of claim 1 wherein said plurality of card magazines have flexible side lips.

5. The device of claim 1 wherein said plurality of delivery trays are located on said top of said rotating plate at a predefined angle to accurately guide a ejected card away from said device.

6. The device of claim 1 wherein said flexible card ejectors are vertically and horizontally adjustable, including a head ejector, wherein the head ejection is made out of soft and flexible material, comprising rubber.

7. The device of claim 1 wherein said playing plate has a window with a conventional hinge to provide access for reloading said plurality of card magazines.

8. The device of claim 1 wherein said playing plate includes a means for pivotal and manual rotation.

9. The device of claim 1 wherein said arm switch includes a locking mechanism.

10. An improved method for providing a user an automatic card shuffler and dealer device, powered by electrical motor, enabling play of recreational card games for a plurality of players sitting around said device while said device automatically ejects playing cards to a plurality of locations, circumferentially spaced about said device, said method comprising:

inserting at least one playing card into at least one card magazine, wherein said at least one card magazine pivotally rotates in a first direction, a built-in spring retracting said at least one card magazine in a second direction, wherein a plurality of stoppers limits said first and second directions;

rotating a rotatable plate, including a top and a bottom, said rotatable plate contacting a fixed plate, said rotatable plate rotated by an electrical motor, controlled by an arm switch, said electrical motor contacting a playing plate through a pivot;

contacting said at least one card by at least one flexible card ejector; and ejecting said at least one card to at least one delivery tray.

11. The device of claim 10 wherein said at least one card magazine is a plurality.

12. The device of claim 11 wherein said plurality of card magazines hold playing cards organized to form a trapezoid shape.

13. The device of claim 11 wherein said plurality of card magazines have a curved lip.

14. The device of claim 11 wherein said plurality of card magazines have flexible side lips.

15. The device of claim 11 wherein said playing plate has a window with a conventional hinge to provide access for reloading said at least one card magazine.

16. The device of claim 1 wherein said playing plate includes a means for pivotal and manual rotation.

17. The device of claim 11 wherein said arm switch includes a locking mechanism.

* * * * *